US011419439B1

(12) United States Patent
Leach

(10) Patent No.: US 11,419,439 B1
(45) Date of Patent: Aug. 23, 2022

(54) PILLOW CASE FOR BODY PILLOW AND PILLOW ASSEMBLY COMPRISING SAME

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 772 days.

(21) Appl. No.: 15/887,138

(22) Filed: Feb. 2, 2018

Related U.S. Application Data

(60) Provisional application No. 62/459,293, filed on Feb. 15, 2017.

(51) Int. Cl.
*A47G 9/02* (2006.01)
*A47G 9/10* (2006.01)

(52) U.S. Cl.
CPC ..... *A47G 9/0253* (2013.01); *A47G 9/10* (2013.01)

(58) Field of Classification Search
CPC ..... A47G 9/0253; A47G 9/10
See application file for complete search history.

(56) References Cited

U.S. PATENT DOCUMENTS 1,927,471 A 9/1933 Salomon
2,167,622 A 8/1939 Bentivoglio
3,327,330 A * 6/1967 McCullough ..... A47G 9/10 5/640
3,604,026 A 9/1971 Schelps
3,789,546 A 2/1974 Morrison
3,974,531 A 8/1976 Van Pelt
4,194,254 A * 3/1980 Torrez ..... A47C 3/16 297/452.16
4,274,673 A * 6/1981 Kifferstein ..... A47G 9/10 297/220
4,393,520 A * 7/1983 Koch ..... A41D 13/08 2/16
4,506,396 A * 3/1985 Ritchie, Jr ..... A47C 20/023 5/631
4,688,286 A 8/1987 Miker, Jr.
4,780,920 A 11/1988 White
D299,988 S * 2/1989 Parabita ..... 5/420
4,834,459 A 5/1989 Leach
4,861,109 A 8/1989 Leach
4,914,765 A 4/1990 Smith
(Continued)

FOREIGN PATENT DOCUMENTS

GB 2045604 11/1980

OTHER PUBLICATIONS

Mecham, Kelly, Giant Pillow Cover, Aug. 22, 2014, (https://blog.rileyblakedesigns.com/giant-pillow-cover/[Aug. 25, 2020 2:57:06 PM]) (Year: 2014).*

*Primary Examiner* — Eric J Kurilla
(74) *Attorney, Agent, or Firm* — Mary M. Lee

(57) ABSTRACT

A pillow case for making a pillow assembly usable as an adult body pillow. The pillow case comprises an elongate fabric enclosure sized to receive two king-size pillows or three standard or queen-size pillows of the user's choice. One or more pockets are provided on one or both sides of the pillow case adjacent one or both of the ends of the pillow case. When the pillow assembly is used as a head or back pillow, the pockets can hold books, phones, facial tissues, medications, and the like, within ready reach. Each of the pockets is positioned so that the opening of the pocket extends along one of the long edges of the pillow case. In this way, when the pillow assembly is used as a body pillow, the pockets can also receive the user's hand and or foot.

18 Claims, 11 Drawing Sheets

(56) References Cited

U.S. PATENT DOCUMENTS

D309,018 S 7/1990 Leach
4,949,887 A 8/1990 Holmes
5,035,013 A 7/1991 Bloom
5,103,514 A 4/1992 Leach
D346,086 S 4/1994 Jones
5,325,818 A 7/1994 Leach
5,430,902 A 7/1995 Lewis
D382,163 S * 8/1997 Hartney ..... D6/597
5,765,245 A * 6/1998 Breto ..... A47G 9/10 5/636
5,864,903 A 2/1999 Newman
6,045,178 A 4/2000 Miller
D431,745 S 10/2000 Jackson
6,267,638 B1 7/2001 Connolly et al.
6,343,727 B1 2/2002 Leach
6,363,557 B2 4/2002 Chou
6,427,251 B1 8/2002 Leach
6,427,268 B1 * 8/2002 Davis ..... A47G 9/0253 5/490
6,463,608 B1 10/2002 Moe
6,499,164 B1 12/2002 Leach
6,553,590 B1 4/2003 Leach
6,601,252 B1 8/2003 Leach
6,625,829 B2 * 9/2003 Zell ..... A47C 7/383 128/DIG. 23
6,643,870 B2 11/2003 Bertrand
D482,923 S * 12/2003 Gaines ..... D6/601
D485,723 S 1/2004 Salazar
6,691,352 B2 2/2004 Wang
6,708,354 B1 3/2004 Carter et al.
6,751,817 B1 6/2004 Leach
6,754,924 B1 6/2004 Brady et al.
6,760,934 B1 7/2004 Leach
6,795,990 B1 * 9/2004 Hutchinson ..... A47C 20/021 5/490
6,971,128 B1 * 12/2005 McGrath ..... A47G 9/0253 5/482
7,010,821 B1 3/2006 Leach
7,089,617 B1 8/2006 Lauro
7,114,206 B2 10/2006 Leach
7,120,953 B2 10/2006 Ferber et al.
7,222,379 B2 5/2007 DiGirolamo
7,322,061 B2 * 1/2008 Carroll ..... A47C 7/383 5/490
7,331,073 B2 * 2/2008 Littlehorn ..... A47C 7/38 5/632
7,353,552 B2 4/2008 Leach
7,430,774 B2 * 10/2008 Littlehorn ..... A47C 16/00 5/632
7,500,278 B2 3/2009 Leach
7,513,001 B1 4/2009 Leach
7,562,406 B1 7/2009 Leach
7,587,773 B2 * 9/2009 Littlehorn ..... A47C 16/00 5/632
7,624,461 B2 12/2009 Tidwell et al.
7,676,871 B1 3/2010 Leach
D613,543 S * 4/2010 Tinker, Sr. ..... D6/601
7,708,342 B2 5/2010 Leach
7,793,371 B1 9/2010 Leach
7,878,587 B1 2/2011 Leach
7,926,135 B1 4/2011 Leach
8,136,186 B1 3/2012 Leach
8,146,760 B1 4/2012 Leach
8,245,339 B2 * 8/2012 Murray ..... A47G 9/10 5/657
8,419,128 B1 4/2013 Leach
8,448,275 B1 5/2013 Leach
8,468,627 B2 6/2013 Leach
8,479,334 B1 7/2013 Leach
8,555,429 B2 10/2013 Leach
8,615,830 B2 12/2013 McQuoid
8,661,587 B1 3/2014 Leach
8,661,588 B1 3/2014 Leach
8,671,480 B1 3/2014 Leach
8,672,724 B2 3/2014 Beuerle
D702,971 S 4/2014 Mitchell
8,914,927 B1 12/2014 Leach
9,003,565 B1 4/2015 Leach
9,009,889 B1 4/2015 Cohen
9,021,635 B1 5/2015 Leach
9,032,572 B1 5/2015 Leach
9,101,169 B1 8/2015 Leach
9,113,718 B1 8/2015 Leach
D737,598 S * 9/2015 Garcia ..... D6/601
9,307,842 B2 4/2016 Gibbons
9,635,956 B1 5/2017 Leach
9,693,638 B1 7/2017 Leach
D898,423 S * 10/2020 Liu ..... D6/601
10,820,718 B1 * 11/2020 Hall ..... A47C 27/144
2005/0278864 A1 12/2005 Leach
2007/0022526 A1 2/2007 Leach
2007/0028384 A1 2/2007 Leach
2007/0046084 A1 3/2007 Leach
2007/0107131 A1 * 5/2007 Fux ..... A47C 7/383 5/636
2007/0151031 A1 7/2007 Leach
2007/0277321 A1 12/2007 Leach
2009/0013466 A1 * 1/2009 Yates ..... A47C 20/021 5/490
2009/0144901 A1 * 6/2009 Zorger ..... A47G 9/0253 5/489
2009/0229054 A1 * 9/2009 Yates ..... A47C 20/021 5/490
2014/0115787 A1 * 5/2014 Garcia ..... A47G 9/10 5/636
2020/0074971 A1 * 3/2020 Rothschild ..... G10K 11/162
2020/0100606 A1 * 4/2020 Ganji ..... A61F 5/56
2021/0251843 A1 * 8/2021 Rivera ..... A47G 9/0253

* cited by examiner

PILLOW CASE FOR BODY PILLOW AND PILLOW ASSEMBLY COMPRISING SAME

CROSS-REFERENCE TO RELATED APPLICATIONS

This application claims the benefit of U.S. provisional application No. 62/459,293, entitled "Pillow Case for Body Pillow and Pillow Assembly Comprising Same," filed Feb. 15, 2017, and the contents of this application are incorporated herein by reference.

FIELD OF THE INVENTION

The present invention relates generally to body support pillows.

DETAILED DESCRIPTION OF AN EMBODIMENT OF THE INVENTION

Body pillows enjoy increasing popularity among consumers. However, for some a full-size adult body pillow is too costly. This is especially the case where the need for the body pillow is temporary. The present invention provides an economical solution to this problem by providing a pillow case sized to receive the user's own bed pillows. While conventional body pillows provide much needed support and comfort, they typically do not come in the wide variety of types and firmness as do standard bed pillows.

The present invention allows the user to create her own customized body pillow by selecting the bed pillows to be used inside the inventive pillow case. This allows the user to select pillows with the firmness and filler type that best suits her particular needs and preferences. Still further, most body pillows sized for adults are necessarily large and bulky making storage an issue. The present invention provides a pillow case that serves as a decorative pillow sham when the assembly is not being used as a body pillow.

Figure 1:
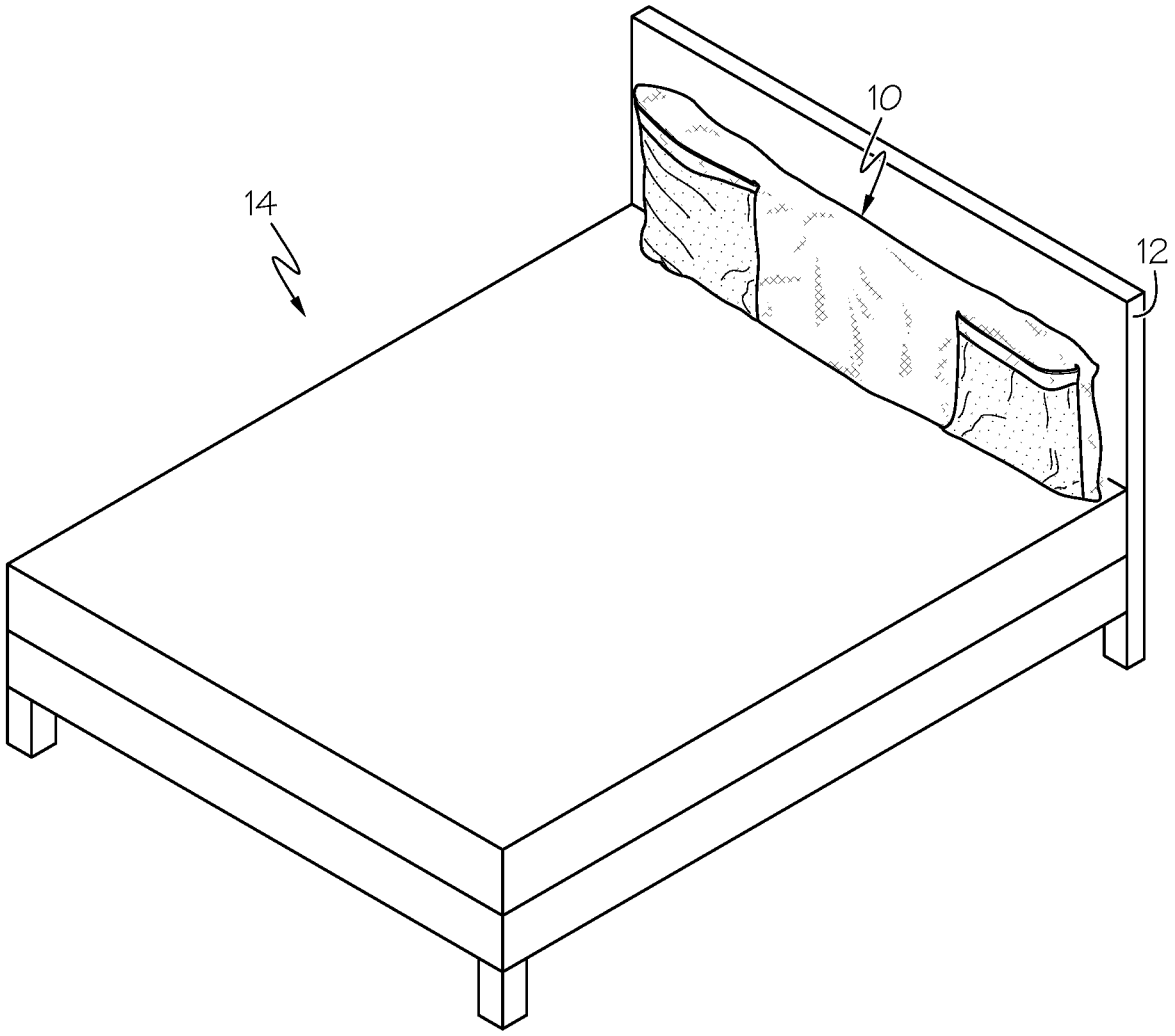
FIG. 1 is a perspective view of a body pillow case made in accordance with an embodiment of the present invention and shown positioned on the head board of a bed. The body pillow case is shown in its resting position with two king-size pillows inside forming a pillow assembly.

Turning now to the drawings in general and to FIG. 1 in particular, there is shown therein a pillow assembly made in accordance with an embodiment of the present invention and designated generally by the reference numeral 10. The pillow assembly 10 is usable as an adult body pillow. In FIG. 1, the pillow assembly 10 is shown propped up against the headboard 12 of a bed 14 illustrating how the inventive pillow assembly can serve as a decorative pillow sham when not in use.

Figure 2:
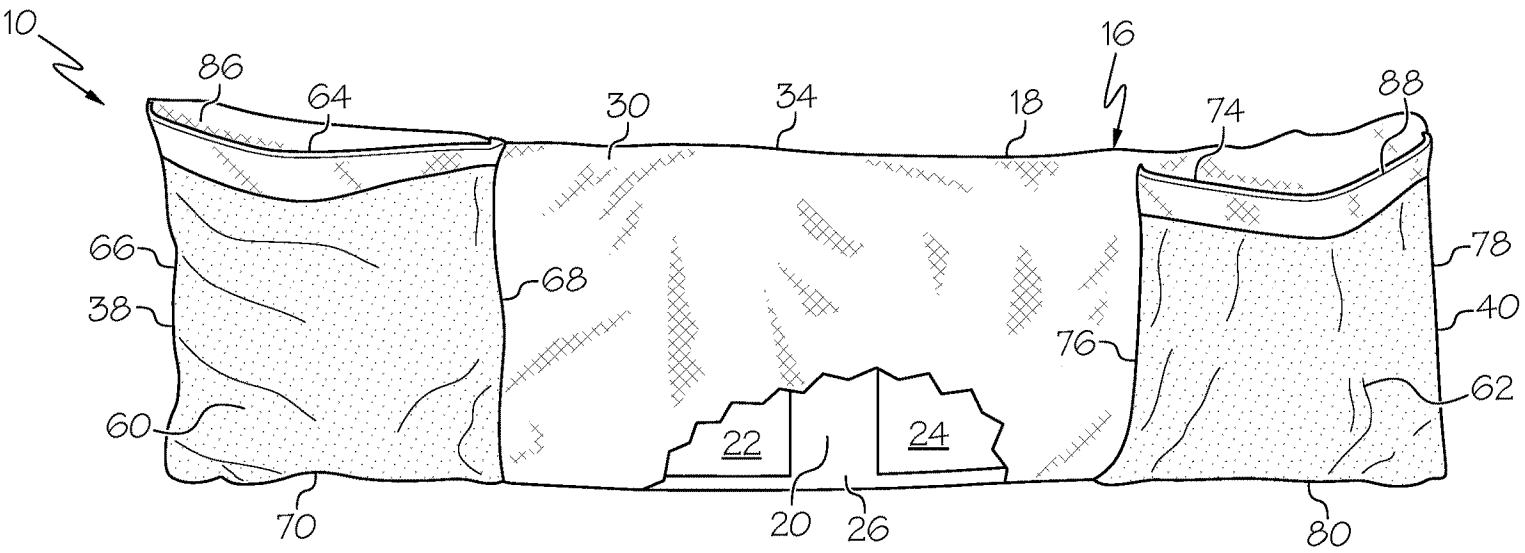
FIG. 2 is a front elevational view of the pillow assembly shown in FIG. 1.
Figure 3:
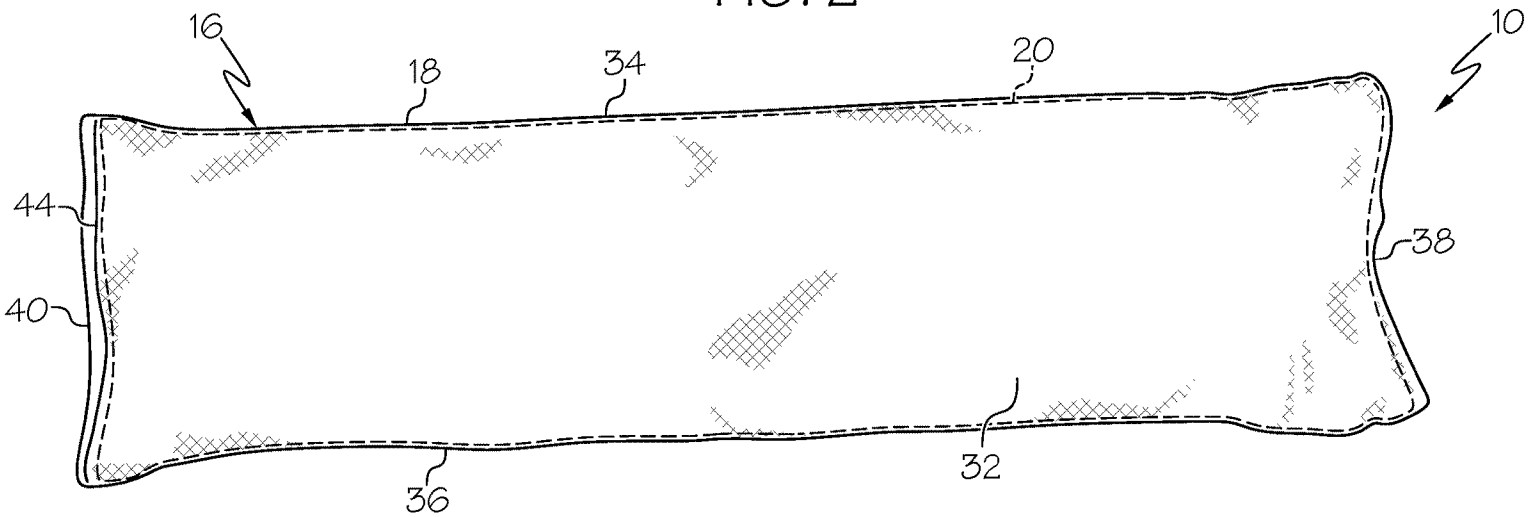
FIG. 3 is a back elevational view of the pillow assembly shown in FIG. 1.

As shown in FIGS. 2 and 3, the pillow assembly 10 includes a pillow case 16 comprising a fabric enclosure 18 that forms an elongate continuous pillow compartment 20 inside. The pillow compartment 20 is sized to receive in an end-to-end arrangement at least two standard-sized bed pillows 22 and 24 (FIG. 1) in a resting condition. As used herein, "resting position" or "resting condition" refers to the position and shape a pillow naturally assumes when no tension or pressure is exerted on any part of it. By way of example, the compartment 20 may be sized to accommodate two standard king-size pillows without applying compression to the pillows and also allowing for some space 26 between the adjacent ends of the pillows for a purpose described hereafter. The user can manipulate the loft, flexibility, and firmness of the pillow assembly 10 by using different sizes of pillows or by using more than two pillows or both. In one embodiment, a pillow assembly with increased firmness is provided by using three standard pillows.

As used herein, "bed pillow" refers to a pillow used primarily to support only the head of a user when reclining, usually in bed. Commercially available bed pillows come in several standardized sizes named for the size of the mattress with which they are intended to be used. According to industry standards, a "king-size" pillow is about 20 by 36 inches, a "queen-size" pillow is about 20 inches by 30 inches, and a "standard" pillow (for a full or double mattress) is about 20 inches by about 26 inches. The term "standard-sized" when used in relation to pillow sizes refers to any of these commercial standards for pillow sizes. The term "standard pillow" refers specifically to the full or double size pillow having the industry standard size. Similarly, the term "queen-size pillow" and "king-size pillow" refer to queen-size and king-size pillows respectively with industry standard sizes.

Referring still to FIGS. 2 and 3, the fabric enclosure 18 has first and second side panels 30 and 32 joined together at their periphery to form first and second side edges 34 and 36 and first and second end edges 38 and 40. There are numerous ways to construct such a pillow case. In one construction, the two side panels are separate but similarly sized pieces of fabric sewn together at their peripheries. Alternately, a single piece of fabric can be folded along its length and stitched around the open edges. Thus, it will be understood that the periphery of the pillow case may or may not comprise a seam where two edges are joined.

Figure 4:
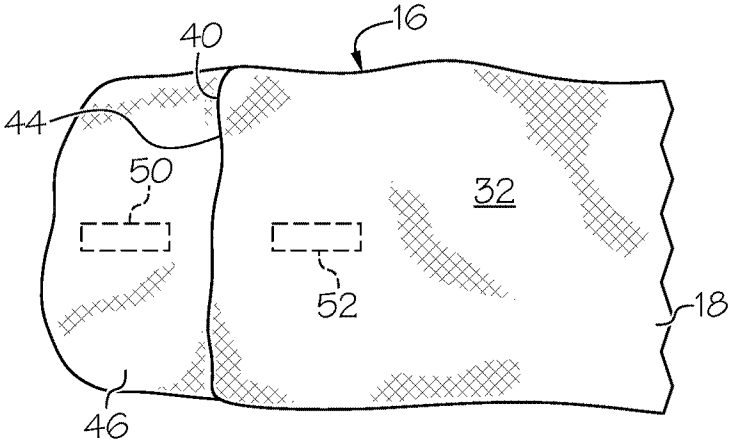
FIG. 4 is a fragmented view of one end of the pillow assembly showing the end flap of the pillow case in the open position. The position of the hook-and-loop fasteners are shown in broken lines.
Figure 5:
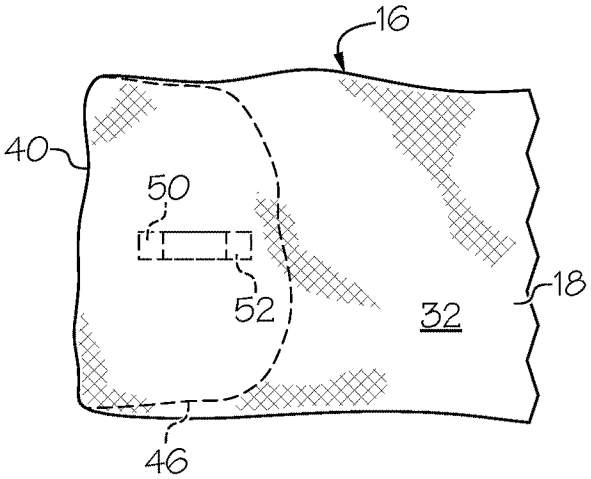
FIG. 5 is a fragmented view of the end of the pillow assembly with the end flap tucked inside the opening in the end of the pillow case so that the hook-and-loop fasteners, shown in broken lines, overlap.

An opening 44 is provided in the enclosure 18 for inserting and removing the bed pillows. The size and location of the opening 44 may vary, but the opening is conveniently provided in one or both of the end edges 38 and 40, as seen in FIGS. 2 and 3. As seen in FIGS. 4 and 5, the opening 44 may include a closure of some type, such as a flap 46. The flap 46 may extend from the end edge 40 of the fabric enclosure 18 and be configured to be folded over and tucked inside the fabric enclosure to close the pillow opening 44.

If desired, a connector can be included to secure the flap 46 in the closed position. More preferably, the connector is an adjustable connector such as hook-and-loop type fasteners. In the illustrative embodiment shown, the connector is a pair of mating hook-and-loop strips 50 and 52 positioned longitudinally on the outside of the flap and on the inside of the enclosure 18. In this arrangement, the connector strips 50 and 52 allow the flap to be pushed further inside the enclosure 18 or pulled further out of the enclosure to vary the overall length of the compartment 20. In this embodiment, the flap 46 is designed to tuck inside the end opening 44. Alternately, the flap may close on the outside of the fabric enclosure. Other types of closures may be employed instead of the flap. By way of example, other suitable enclosures may include a sham-style closure formed of fabric. Still further, other connectors may be employed, such as zippers, buttons, snaps, ties, buckles, hooks, and the like, or a combination of closure types.

Referring again to FIG. 2, the pillow case 16 may include one or more pockets on the outside of the enclosure 18. Preferably, the case 16 includes first and second pockets 60 and 62 both on the first side panel 30 of the enclosure 18. The first pocket 60 may include a top edge 64, first and second side edges 66 and 68, and a bottom edge 70. Similarly, the second pocket 62 may include a top edge 74, first and second side edges 76 and 78, and a bottom edge 80.

Figure 7:
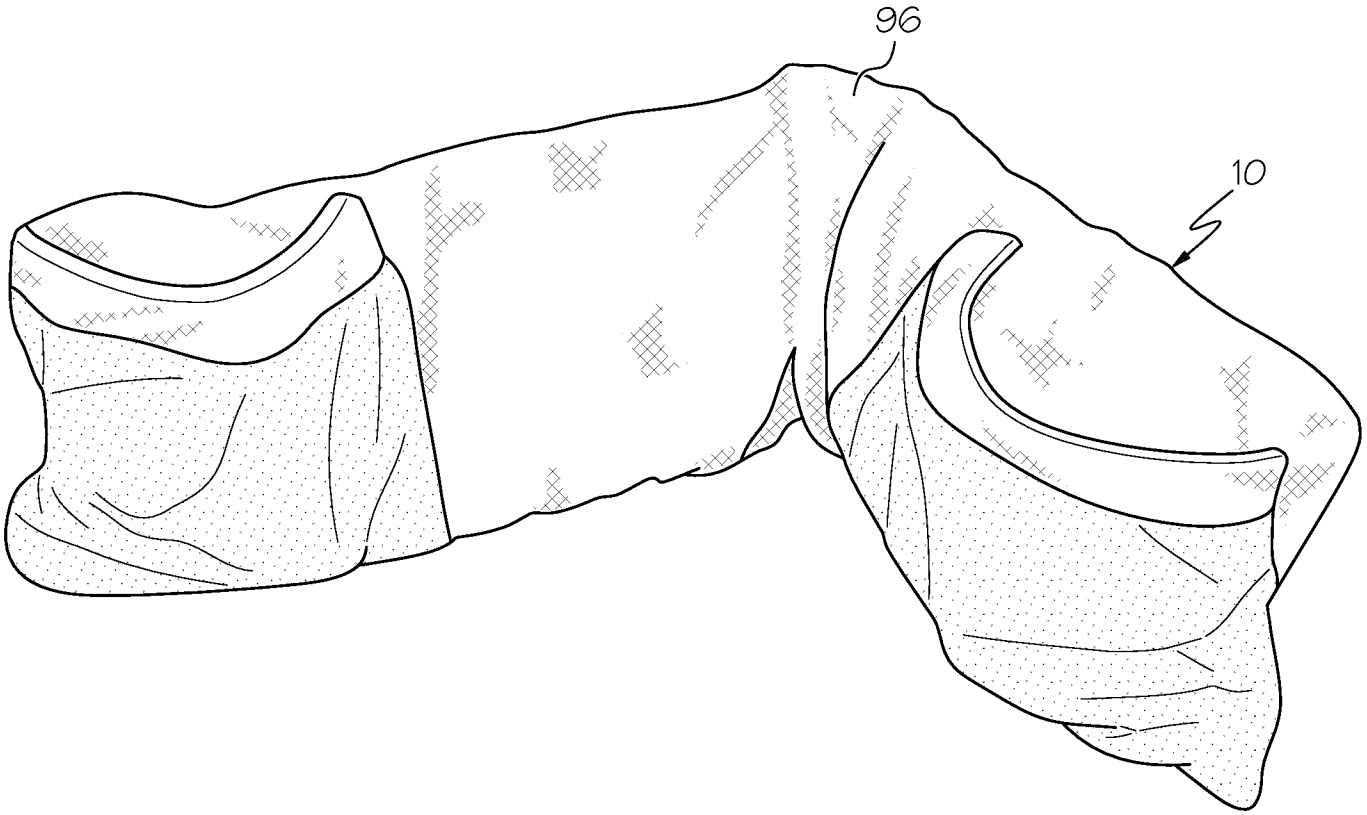
FIG. 7 is a perspective view of the pillow assembly positioned upright and folded in the middle at the "joint" between the adjacent ends of the king-size pillows inside.

The pockets 60 and 62 may each comprise a square or rectangular piece of fabric stitched to the first side panel 30 and preferably are spaced a distance apart so that the first side edge 76 of the second pocket 62 is spaced a distance from the second side edge 68 of the first pocket 60 forming a pocket-free zone therebetween, as seen in FIGS. 2 and 7. Most preferably, the side edge 66 of the first pocket 60 is adjacent to the first end edge 38, and the side edge 78 of the second pocket 62 is adjacent the second end edge 40. The bottom edges 70 and 80 of the pockets 60 and 62 may be attached adjacent to the second side edge 36 of the enclosure 18. The top edges 64 and 74 of the pockets 60 and 62 may be left unattached to the first side panel 30 to form an opening 86 and 88, respectively, in each pocket. Where the enclosure 18 includes a seam along the second side edge 36, the bottom edges 70 and 80 conveniently may be stitched into that seam. Similarly, the side edges 66 and 78 may be sewn into a seam forming the ends 38 and 40 of the enclosure 18.

Now it will be appreciated that each of the pockets 60 and 62 has a length extending from the open top edges 64 and 74 to the bottom edges 70 and 80. Similarly, elongate fabric enclosure 18 has a length extending from the first end edge 38 to the second end edge 40. Thus, the pocket 60 and 62 are arranged perpendicular to the length of the enclosure 18. This position of the pockets 60 and 62 on the pillow case 16 is advantageous as it provides secure placement for personal articles when the pillow assembly is used as shown in FIG. 1. Still further, as will be explained more fully below, when the user is in a side-lying position with the pillow assembly 10 being used as a body pillow, the pockets 60 and 62 are ideally oriented to receive the user's hands or feet for warmth.

Figure 6:
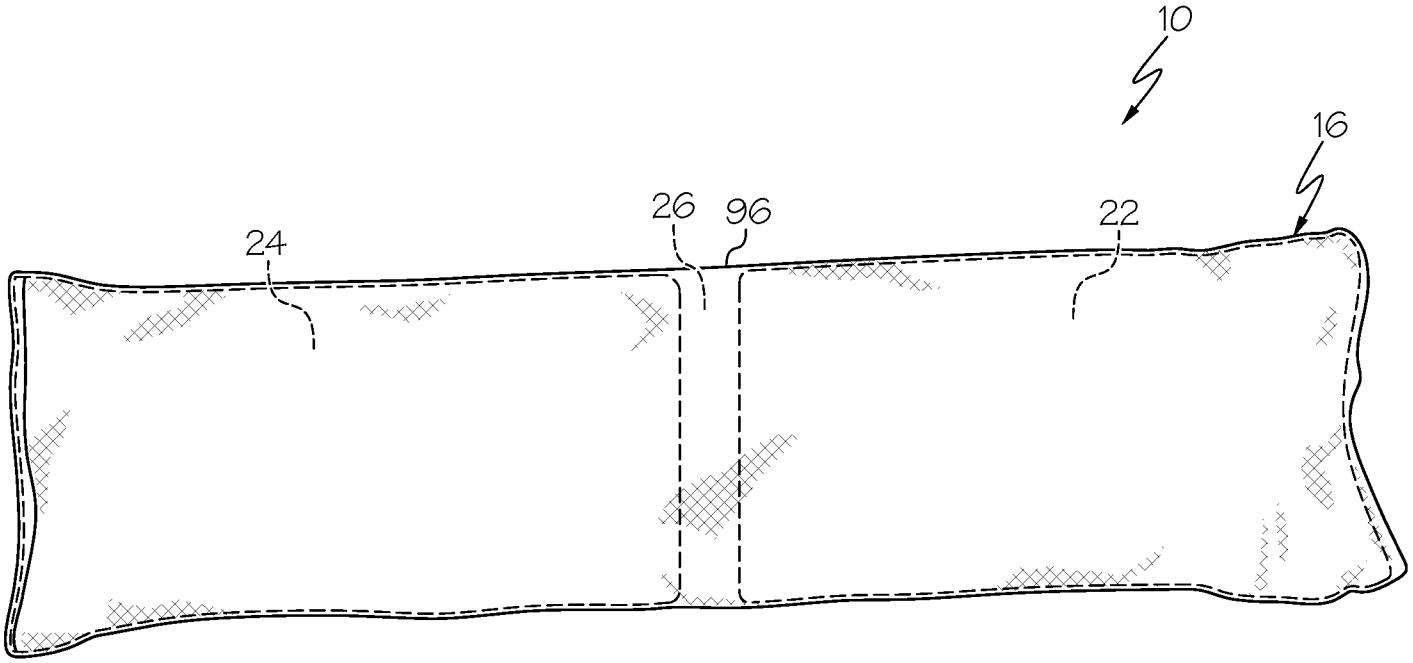
FIG. 6 is a back view of the inventive pillow assembly comprising the body pillow case with two king-size pillows inside.

The shape and dimensions of the pillow case 16 may vary. However, as described above and as shown in FIGS. 6 and 7, the pillow case 16 should be sized to receive in an end-to-end arrangement at least two standard-sized bed pillows 22 and 24 in a resting condition leaving a small space 26 between the ends of the pillows. This space 26 creates a natural hinge or joint 96 transversely in the middle of the pillow assembly 10 that facilitates the bending or folding of the pillow, as depicted in FIG. 7. The pillow case 16 should be rectangular. The first and second side edges 34 and 36 should be straight and parallel to each other and have the same length, and the first and second end edges 38 and 40 also should be should be straight and parallel to each other and have the same length.

Figure 8:
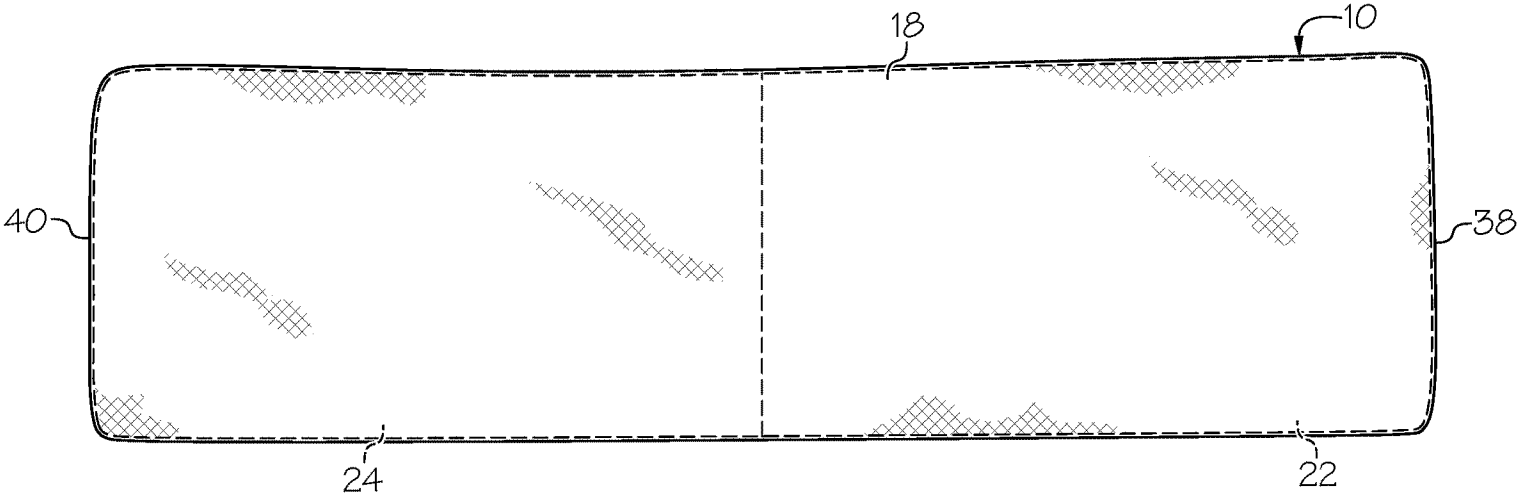
FIG. 8 is a back elevational view of the pillow assembly. The king-size pillows inside have been pushed together to increase the firmness of the pillow assembly.
Figure 9:
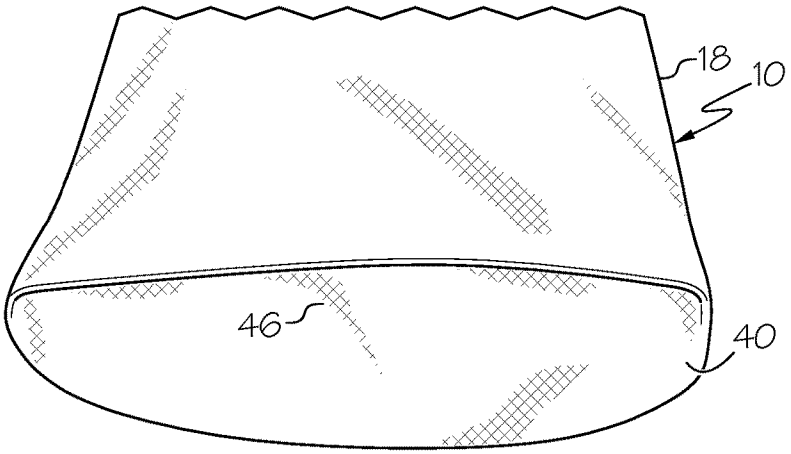
FIG. 9 shows a perspective view of the end of the pillow assembly of 8. The end flap has been tucked further inside to maintain a taught enclosure for the pillows inside.
Figure 10:
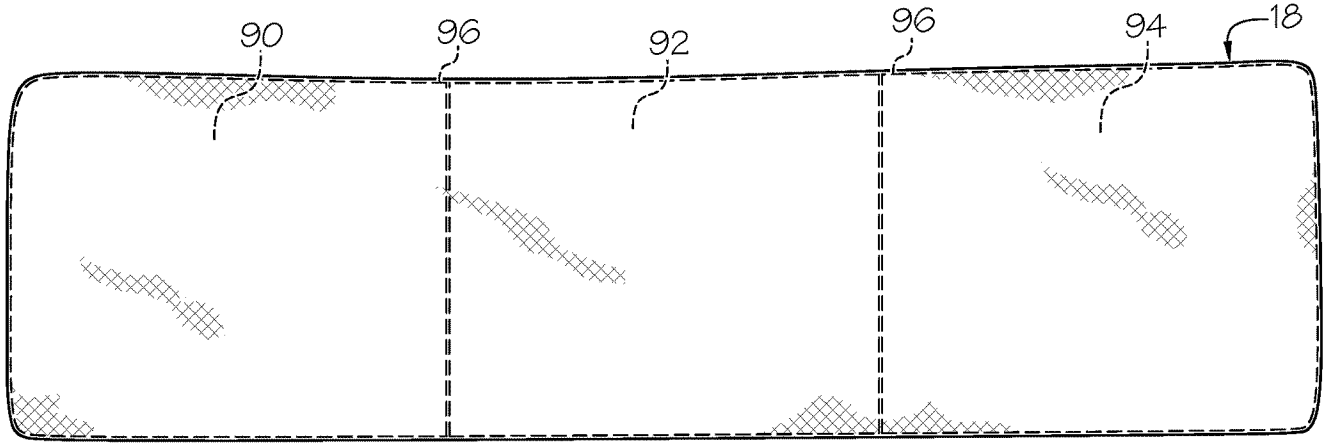
FIG. 10 is a back elevational view of the pillow case with three standard-sized pillows inside providing a firmer support with maximum length of the pillow assembly.

For a slightly firmer pillow and higher loft, the two king-size pillows 22 and 24 may be pushed together more tightly compressing the pillows inside the enclosure 18 as shown in FIG. 8. As shown in FIG. 9, the resulting slack in the open end 40 of the enclosure 18 may be taken up by pushing the flap 46 further inside. This will maintain pillows 22 and 24 in the compressed position. Alternately, as seen in FIG. 10, the two king-size pillows 22 and 24 may be replaced with three standard pillows 90, 92, and 94. The use of three standard pillows provides comparable loft but more flexibility because of the additional joint between the second and third pillow. Alternately, enclosure 18 will accommodate three king-size pillows, or three or four queen-size pillows, or three or four standard pillows. Thus, the pillow assembly 10 enables a high degree of customization, according to the user's preference, while making use of standard-sized pillows probably already on-hand.

The dimensions of the pillow assembly 10 may vary. The length of the pillow case 16 (the distance from the first end edge 38 to the second end edge 40) may be between about 65-75 inches and most preferably is about 70 inches. The width of the pillow case 16 (the distance between the first side edge 34 and the second side edge 36) may be between about 18 and 22 inches and more preferably about 20 inches.

The width of the pockets 60 and 62 (between the first and second side edges 66 and 68 and 76 and 78) may be between about 15 and 20 inches, and most preferably is about 18 inches.

Figure 11:
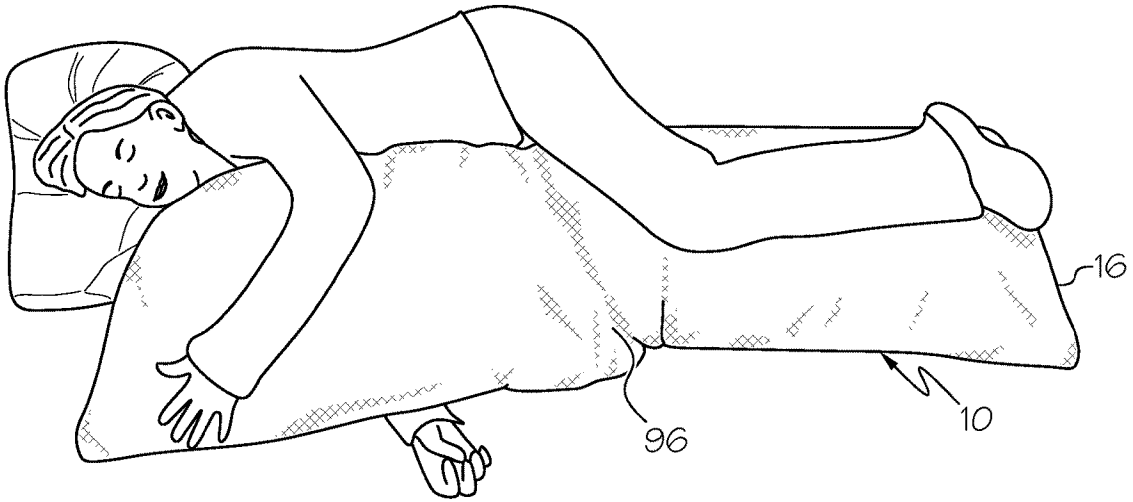
FIG. 11 is an illustration of a user position for the pillow of FIG. 1. The user is in a side-lying position with the bottom half of the pillow assembly between her knees and the top half aligned with her torso and supporting her arm. The space between the adjacent ends of the pillows inside allows the pillow assembly to slightly collapse and bend easily in the middle.

Having described the structure of the pillow assembly 10, its use will be explained with reference to FIGS. 11-17. FIG. 11 is an illustration of a user position for the pillow assembly 10 shown of FIG. 1. The user is in a side-lying position with the bottom half of the pillow assembly 10 between her knees and the top half aligned with her torso and supporting her arm. The space or joint 96 between the adjacent ends of the pillows inside the pillow case 16 allows the pillow assembly to slightly collapse and bend easily in the middle.

Figure 12:
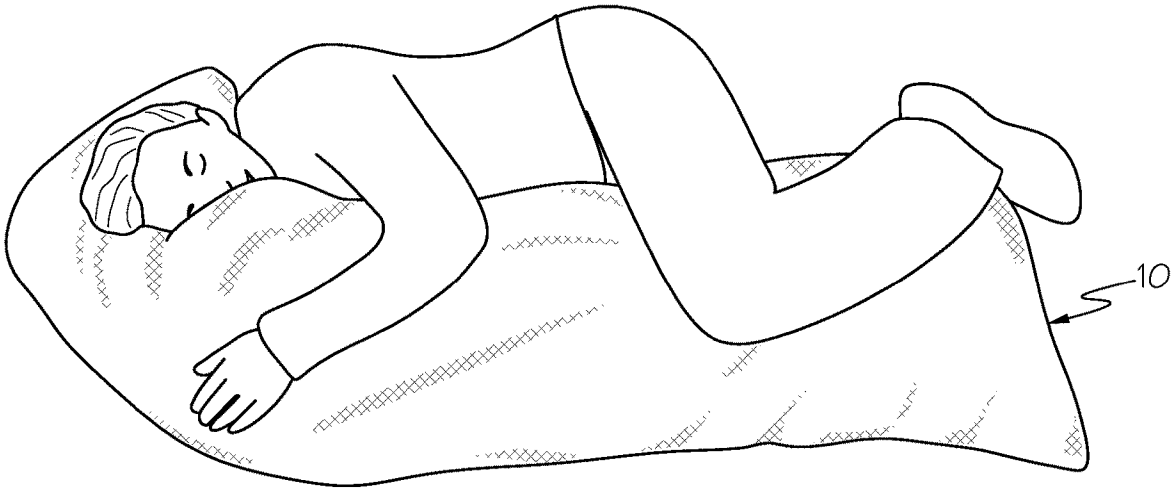
FIG. 12 is an illustration of another user position for the pillow of FIG. 1. The user is in a side-lying position with the bottom half of the pillow assembly between her knees and the top half curving under her head.
Figure 13:
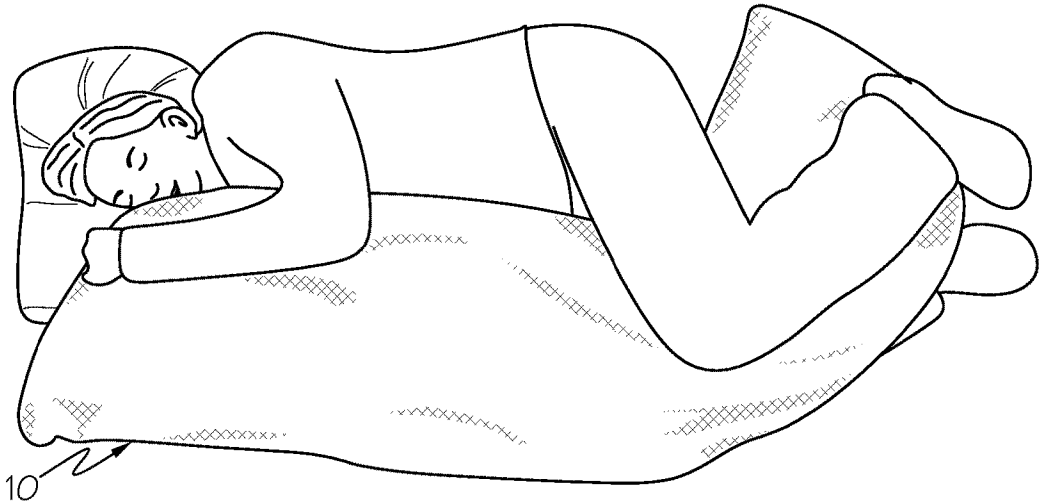
FIG. 13 is an illustration of another user position for the pillow of FIG. 1. The user is in a side-lying position with the bottom half of the pillow assembly bent inward between her knees and ankles and the top half aligned with her torso and supporting her arm. The space between the adjacent ends of the pillows inside allows the pillow assembly to bend easily in the middle.

FIG. 12 is an illustration of another user position for the pillow assembly 10. The user is in a side-lying position with the bottom half of the pillow assembly between her knees and the top half curving under her head. FIG. 13 is an illustration of another user position. The user is in a side-lying position with the bottom half of the pillow assembly bent inward between her knees and ankles and the top half aligned with her torso and supporting her arm.

Figure 14:
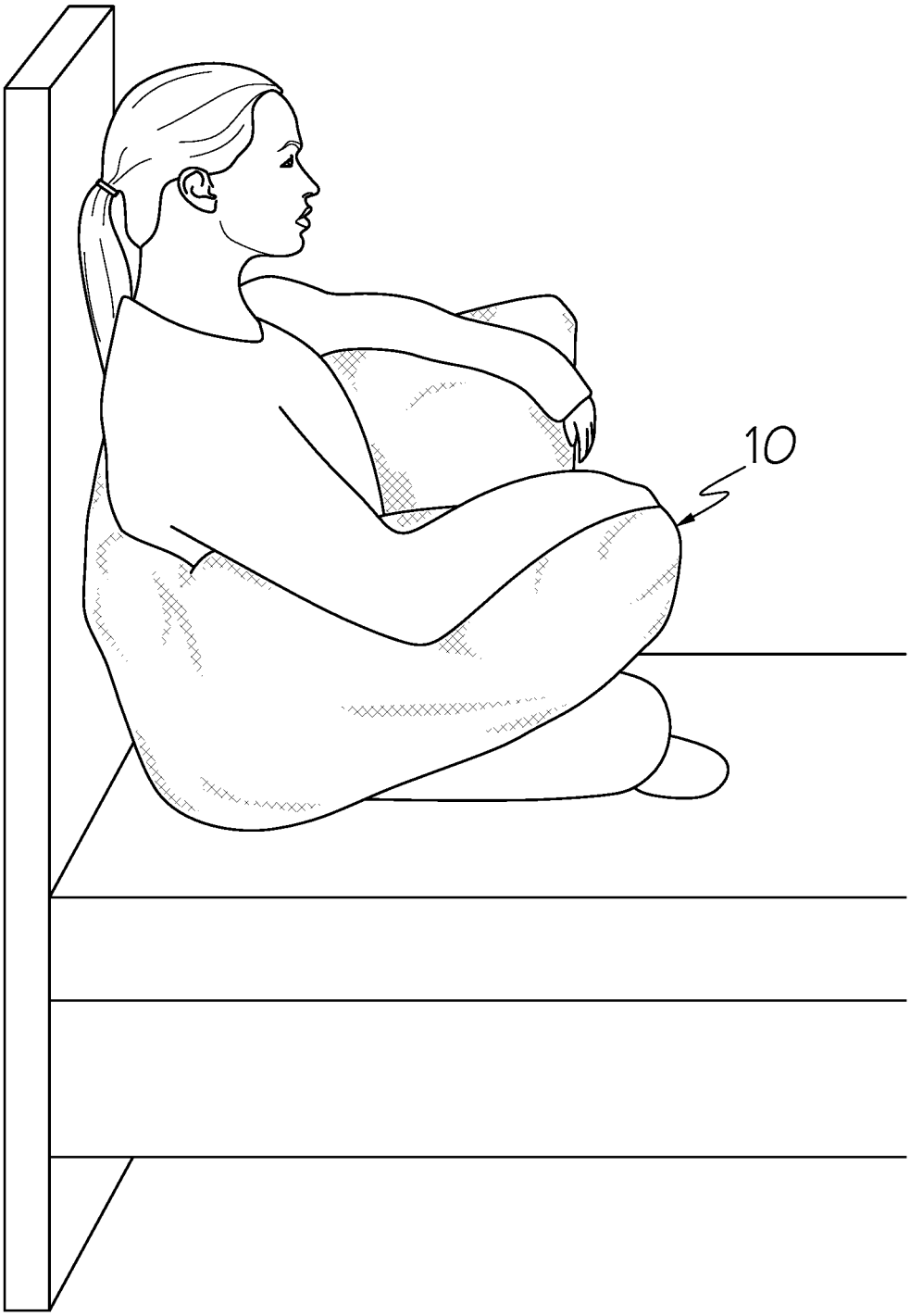
FIG. 14 illustrates the pillow assembly arranged for use in a sitting position as a study pillow up against a headboard of a bed.
Figure 15:
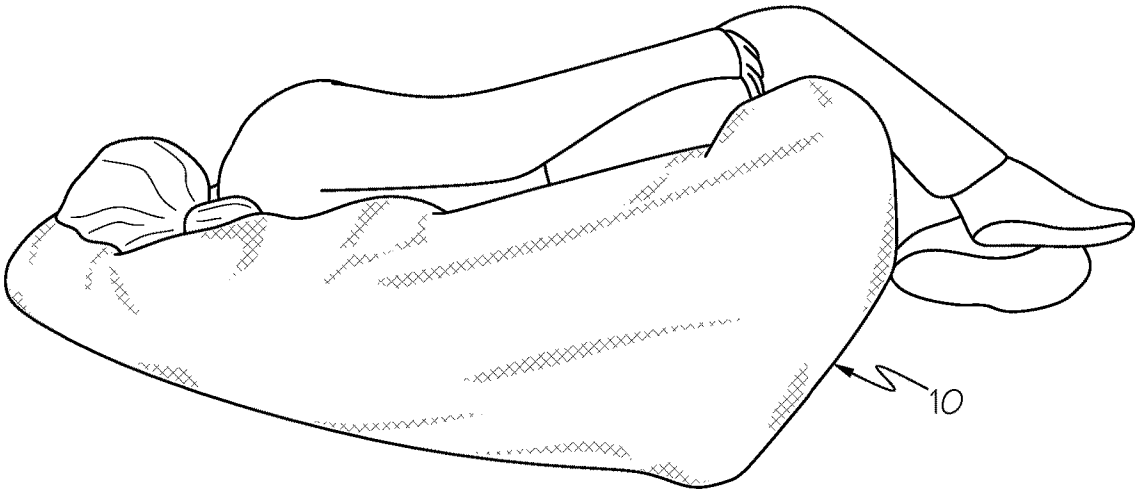
FIG. 15 shows another user position for the pillow of FIG. 1. The user is in a side-lying position with her back and head supported by the top half of the pillow and the bottom half of the pillow assembly bent inward between her knees.

FIG. 14 illustrates the pillow assembly arranged for use in a sitting position as a study pillow up against a headboard 12 of a bed 14 (FIG. 1). FIG. 15 shows the user is in a side-lying position with her back and head supported by the top half of the pillow and the bottom half of the pillow assembly bent inward between her knees.

Figure 16:
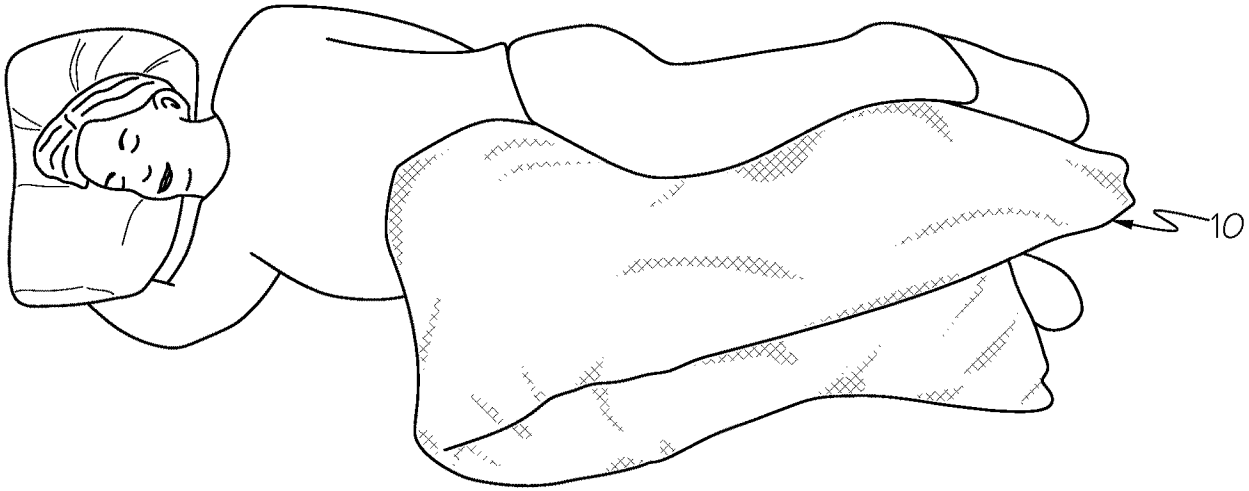
FIG. 16 illustrates the pillow assembly in yet another body position. The pillow assembly is folded over at the hinge or joint providing a double thickness.
Figure 17:
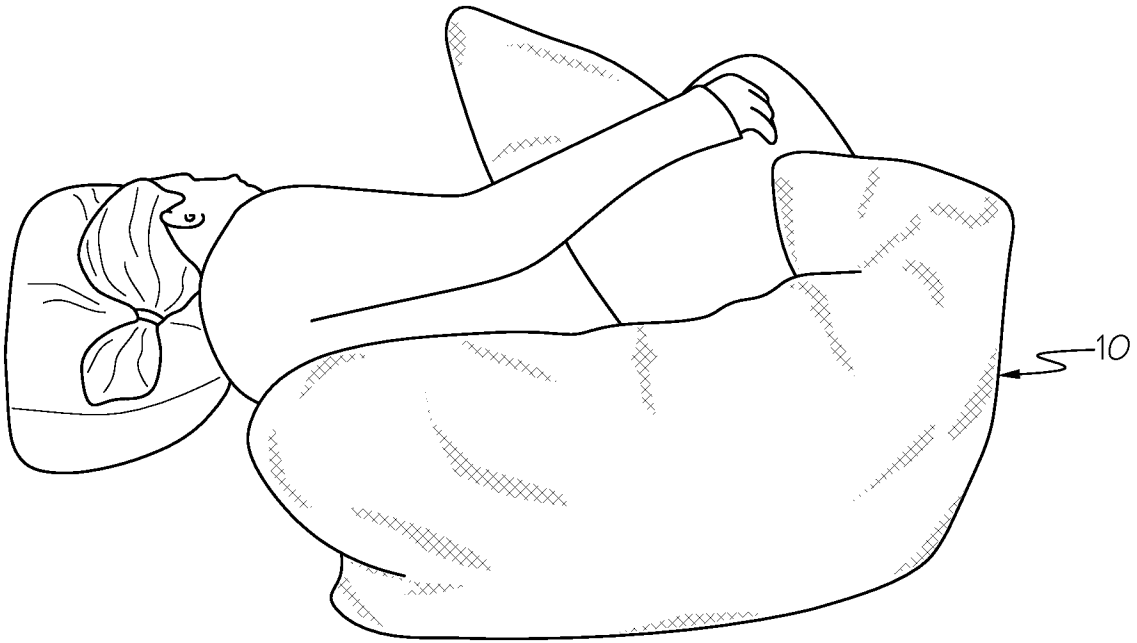
FIG. 17 illustrates the pillow assembly in yet another body position. The user is in a side-lying position with her back supported by the top half of the pillow and the bottom half of the pillow assembly bent inward between her legs.

FIG. 16 illustrates the pillow assembly 10 in yet another body position. The pillow assembly 10 is folded over at the hinge or joint 96 providing a double thickness. In the position shown in FIG. 17 the user is in a side-lying position with her back supported by the top half of the pillow and the bottom half of the pillow assembly bent inward between her legs.

The pockets 60 and 62 are not shown in FIGS. 11-17 in order to simplify the illustration. However, it will now be apparent that the pockets are useful when the assembly 10 is being used as a body pillow. The side opening pocket at the head end of the pillow is easily accessible as a hand warmer. Additionally, items that may be needed during the night may be kept in the upper pocket. For example, tissues, an inhaler, or heart medicine may be kept in the pocket and accessed during the night without having to reposition the pillow. The "sideways" (perpendicular) orientation of the pockets means the user can easily insert her foot into the pocket on the lower end of the pillow. This keeps her foot warm, and she can use her foot to move the end of the pillow around to the most comfortable position.

The following issued US patents are incorporated herein by reference: (1) U.S. Pat. No. 7,793,371, entitled "Apparatus and Method for Question Mark-Shaped Body Pillow and Support System," issued Sep. 14, 2010; (2) U.S. Pat. No. 8,468,627, entitled "Elongated Angular Multiple Position Body Pillow," issued Jun. 25, 2013; (3) U.S. Pat. No. 7,010,821, entitled "Expandable Double Nursing Pillow," issued Mar. 14, 2006; (4) U.S. Pat. No. 7,353,552, entitled "Multiple Position Symmetrically Contoured Body Pillow," issued Apr. 8, 2008; (5) U.S. Pat. No. 6,499,164, entitled "Body Pillow With Horseshoe-Shaped Top and J-Shaped Bottom," issued Dec. 31, 2002; (6) U.S. Pat. No. 6,751,817, entitled "Contoured Body Pillow," issued Jun. 22, 2004; (7) U.S. Pat. No. 6,760,934, entitled "Symmetrically Contoured Support Pillow," issued Jul. 13, 2004; (8) U.S. Pat. No. 9,021,635, entitled "Body Pillow with Multiple Configurations," issued May 5, 2015.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present invention have been described in the drawings and accompanying text, the description is illustrative only. Changes may be made in the details, especially in matters of shape, size, and arrangement of the parts within the principles of the invention to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow case for making a pillow assembly usable as an adult body pillow, the pillow case comprising:

a fabric enclosure forming an elongate continuous pillow compartment sized to receive in an end-to-end arrangement at least two standard-sized bed pillows;

wherein the fabric enclosure has first and second side panels joined at their peripheries to form first and second side edges and first and second end edges of the fabric enclosure;

wherein the fabric enclosure comprises a pillow opening for inserting and removing the bed pillows;

a first pocket on the first side panel of the fabric enclosure, the first pocket having a top edge, first and second side edges, and a bottom edge;

wherein the first pocket includes a pocket opening extending along its top edge, wherein the first side edge of the first pocket is positioned adjacent the first end edge of the fabric enclosure, and wherein the top edge of the first pocket and the pocket opening are adjacent the first side edge of the first side panel;

a second pocket on the first side panel of the fabric enclosure, the second pocket having a top edge, first and second side edges, and a bottom edge; and wherein the second pocket includes a pocket opening extending along its top edge, wherein the second side edge of the second pocket is positioned adjacent the second end edge of the fabric enclosure, wherein the first side edge of the second pocket is spaced a distance from the second side edge of the first pocket defining the pocket-free zone therebetween, and wherein the top edge of the second pocket and the pocket opening are adjacent the first side edge of the first side panel.

2. The pillow case of claim 1 wherein the pillow compartment is sized to receive two king-size pillows.

3. The pillow case of claim 1 wherein the pillow compartment is sized to receive three queen-size pillows.

4. The pillow case of claim 1 wherein the pillow compartment is sized to receive three standard pillows.

5. The pillow case of claim 1 wherein the pillow opening is along one of the first and second end edges of the fabric enclosure.

6. The pillow case of claim 5 further comprising a flap extending from the one of the first and second end edges of the fabric enclosure with the pillow opening and configured to be folded over and tucked inside the fabric enclosure to close the pillow opening.

7. The pillow case of claim 6 further comprising an adjustable connector to attach the flap inside the fabric enclosure.

8. The pillow case of claim 1 wherein the bottom edges of the first and second pockets are adjacent the second side edge of the fabric enclosure.

9. A pillow assembly comprising the pillow case of claim 1 with two king-size pillows inside.

10. A pillow assembly comprising the pillow case of claim 1 with three standard pillows inside.

11. A pillow assembly comprising the pillow case of claim 1 with two queen-size pillows inside.

12. A method for making a body pillow comprising inserting two king-size bed pillows in an end-to-end arrangement into the pillow compartment of the pillow case of claim 1.

13. A method for making a body pillow comprising inserting three queen-size bed pillows in an end-to-end arrangement into the pillow compartment of the pillow case of claim 1.

14. A method for making a body pillow comprising inserting three standard bed pillows in an end-to-end arrangement into the pillow compartment of the pillow case of claim 1.

15. The pillow case of claim 1 wherein the first and second side edges of the fabric enclosure have the same length and are straight and parallel to each other, wherein the first and second end edges of the fabric enclosure have the same length and are straight and parallel to each other, and wherein the length of the first and second side edges is between about 65 and 75 inches and the length of the first and second end edges is between about 18 and 22 inches.

16. The pillow case of claim 15 wherein the length of the first and second side edges is about 70 inches and the length of the first and second end edges is about 20 inches.

17. The pillow case of claim 1 wherein the first and second side edges of the fabric enclosure have the same length and are straight and parallel to each other, wherein the first and second end edges of the fabric enclosure have the same length and are straight and parallel to each other, wherein the length of the first and second side edges is between about 65 and 75 inches, wherein the length of the first and second end edges is between about 18 and 22 inches, and wherein the width of each of the first and second pockets is between about 15 and 20 inches.

18. The pillow case of claim 17 wherein the length of the first and second side edges is about 70 inches and the length of the first and second end edges is about 20 inches and wherein the width of each of the first and second pockets is about 18 inches.

* * * * *